US006472812B2

(12) United States Patent
Vose et al.

(10) Patent No.: US 6,472,812 B2
(45) Date of Patent: Oct. 29, 2002

(54) FLUORESCENT COLORTONE LAMP WITH REDUCED MERCURY

(75) Inventors: Kelly S. Vose, Latrobe, PA (US); Brett A. Carter, Salina, KS (US); Emmanuel W. J. L. Oomen, Aachen (DE)

(73) Assignee: Koninklijke Philips Electronics N.V. (NL)

( * ) Notice: Subject to any disclaimer, the term of this patent is extended or adjusted under 35 U.S.C. 154(b) by 183 days.

(21) Appl. No.: 09/739,514

(22) Filed: Dec. 18, 2000

(65) Prior Publication Data

US 2002/0117966 A1 Aug. 29, 2002

(51) Int. Cl.[7] ..... H01J 1/62
(52) U.S. Cl. ..... 313/486; 313/487
(58) Field of Search ..... 313/486, 487, 313/635, 639

(56) References Cited

U.S. PATENT DOCUMENTS

| | | | |
|---|---|---|---|
| 3,748,517 A | 7/1973 | Haft | 313/109 |
| 5,714,836 A | 2/1998 | Hunt et al. | 313/487 |
| 5,838,101 A | 11/1998 | Pappalardo | 313/487 |

FOREIGN PATENT DOCUMENTS

| | | | |
|---|---|---|---|
| EP | 0385275 A3 | 5/1990 | H01J/61/38 |
| EP | 0385275 A2 | 5/1990 | H01J/61/38 |

OTHER PUBLICATIONS

Patent Abstracts of Japan: Publication No. 07254390 A; Date of Publication, Oct. 3, 1995; Publication No. 07254390 A; Application No. 06044274.
Patent Abstract of Japan: Publication No. 09153345 A; Date of Publication: Jun. 10, 1997; Application No. 07312610.
Patent Abstract of Japan: Publication No. 05287269; Date of Publication Apr. 13, 1992, Application No. 00925235.
Database WPI, Section Ch, Week 198017, Derwent Publications Ltd., London, GB; Class L03, An 1980–30101C, XP002193294 & JP 55/035423A (Tokyo Shibaura Electric Co), Dec. 3, 1980.

*Primary Examiner*—Vip Patel
(74) *Attorney, Agent, or Firm*—Dicran Halajian

(57) ABSTRACT

An electric lamp has an envelope with an inner surface and two electrodes located at each end of the envelope. The electrodes transfer electric power to generate ultraviolet radiation in the envelope which is filled with mercury and a charge sustaining gas. The inner surface of the envelope is pre-coated with an aluminum oxide layer to reflect ultraviolet radiation back into the envelope. A phosphor layer is formed over the aluminum oxide to convert the ultraviolet radiation to visible light. The phosphor layer is a mixture of four phosphors, namely, blue luminescing Blue Halophosphor (BH), red-luminescing Yittrium Oxide (YOX), 3000K-luminescing Calcium Halophosphor, also referred to as Warm White (WW) and green-luminescing Zinc Silicate (ZS).

20 Claims, 2 Drawing Sheets

FLUORESCENT COLORTONE LAMP WITH REDUCED MERCURY

BACKGROUND OF THE INVENTION

1. Field of the Invention

The present invention is directed to low pressure mercury vapor lamps, more commonly known as fluorescent lamps, having a lamp envelope with phosphor coating, and more particularly, to a coating with four phosphors over an alumina pre-coat.

2 Discussion of the Prior Art

Low pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (UV) region of the spectrum, with only a small portion in the visible spectrum. The inner surface of the lamp envelope has a luminescent coating, often a blend of phosphors, which emits visible light when impinged by the ultraviolet radiation.

There is an increase in the use of fluorescent lamps because of reduced consumption of electricity. To further reduce electricity consumption, there is a drive to increase efficiency of fluorescent lamps, referred to as luminous efficacy which is a measure of the useful light output in relation to the energy input to the lamp, in lumens per watt (LPW).

Thus, more efficient and longer life fluorescent lamps are desired. However, significant excess of mercury is introduced into the lamp to meet desired long lamp lifetime of 20,000 hours or more. This is necessary because different lamp components, such as the glass envelope, phosphor coatings and electrodes use up the mercury in the lamp. Such increased use of mercury is not desirable and is detrimental to the environment. Accordingly, there is a drive to reduce mercury consumption in fluorescent lamps without a reduction in the lamp life.

To increase efficiency and reduce mercury consumption without a reduction in the lamp life, different blends of phosphors are used for the luminescent coating. Further, a metal oxide layer is provided between the luminescent coating and glass envelope. The metal oxide layer reflects the UV radiation back into the phosphor luminescent layer through which it has already passed for further conversion of the UV radiation to visible light. This improves phosphor utilization and enhances light output. The metal oxide layer also reduces mercury consumption by reducing mercury bound at the tubular portion of the lamp.

Desirable fluorescent lamps characteristics include high brightness and high color rendering. Fluorescent lamps referred to as "Colortone" lamps belong to a family of light sources having high color rendering indices (CRI). These particular fluorescent lamps are used to alleviate seasonal disorders and are used in several professional applications where the color rendering property is critical. For example, these Colortone fluorescent lamps are widely used in museums, flower shops, graphic art studios, as well as dental and doctor offices.

Colortone 50 lamps have a correlated color temperature of 5000K, with a high CRI being greater than 90. There are organizations that promulgate standards that specify particular minimum values for the CRI and other lamp specification, such at the American National Standard Institute (ANSI) and the International Standard Organization (ISO) standards. For the Colortone 50 lamps, the ANSI and ISO standards require that the CRI must be over 90. The ISO standard further requires that the separate color rendering indices $R_1$–$R_8$ be over 80. Conventional Colortone 50 lamps are made with phosphors that are high consumers of mercury, and cannot pass the TCLP (Toxicity Characteristic Leaching Procedure) test without sacrificing lamp life.

In particular, a conventional fluorescent Colortone 50 lamp is made with a two-phosphor mixture of Strontium Magnesium Phosphor (Sr. Mag), i.e., $(Sr,Mg)_3(PO_4)_2$:Sn, and Strontium Fluorophosphor (Sr. Blue), i.e., $Sr_{10}(PO_4)_6F_2$:Sb. The Sr. Mag is very rich in the red region of the spectrum and the Sr. Blue contributes to the blue characteristics of the Colortone 50.

The combination of these two-phosphors produces a broad spectrum in the visible region with high color rendering properties being greater than 90. However, these phosphor mixtures are detrimental for mercury consumption. In particular, Sr. Mag and Sr. Blue are high consumers of mercury, where Sr. Mag is the highest consumer of mercury and its high percentage renders the conventional Colortone 50 lamps non-TCLP compliant.

Accordingly, there is a need for fluorescent Colortone lamps with high CRI and reduced mercury that pass TCLP.

SUMMARY OF THE INVENTION

The object of the present invention is to provide fluorescent Colortone lamps with high CRI and reduced mercury consumption.

The present invention accomplishes the above and other objects by providing an electric lamp having an envelope with an inner surface and at least one electrode, such as two electrodes located at both ends of the envelope tube. The electrodes transfer electric power to generate ultraviolet radiation in the envelope which is filled with mercury and a charge sustaining gas. The inner surface of the envelope is pre-coated with a metal oxide layer, such as an aluminum oxide layer, to reflect ultraviolet radiation back into the envelope.

A phosphor layer is formed over the aluminum oxide to convert the ultraviolet radiation to visible light. The phosphor layer for a 5000K Colortone lamp is a mixture of four phosphors, namely, blue luminescing Blue Halophosphor (BH), red-luminescing Yittrium Oxide (YOX), 3000K-luminescing Calcium Halophosphor, also referred to as Warm White (WW) and green-luminescing Zinc Silicate (ZS).

BRIEF DESCRIPTION OF THE DRAWINGS

Further features and advantages of the invention will become more readily apparent from a consideration of the following detailed description set forth with reference to the accompanying drawings, which specify and show preferred embodiments of the invention, wherein like elements are designated by identical references throughout the drawings; and in which.

DETAILED DESCRIPTION OF THE INVENTION

Figure 1:
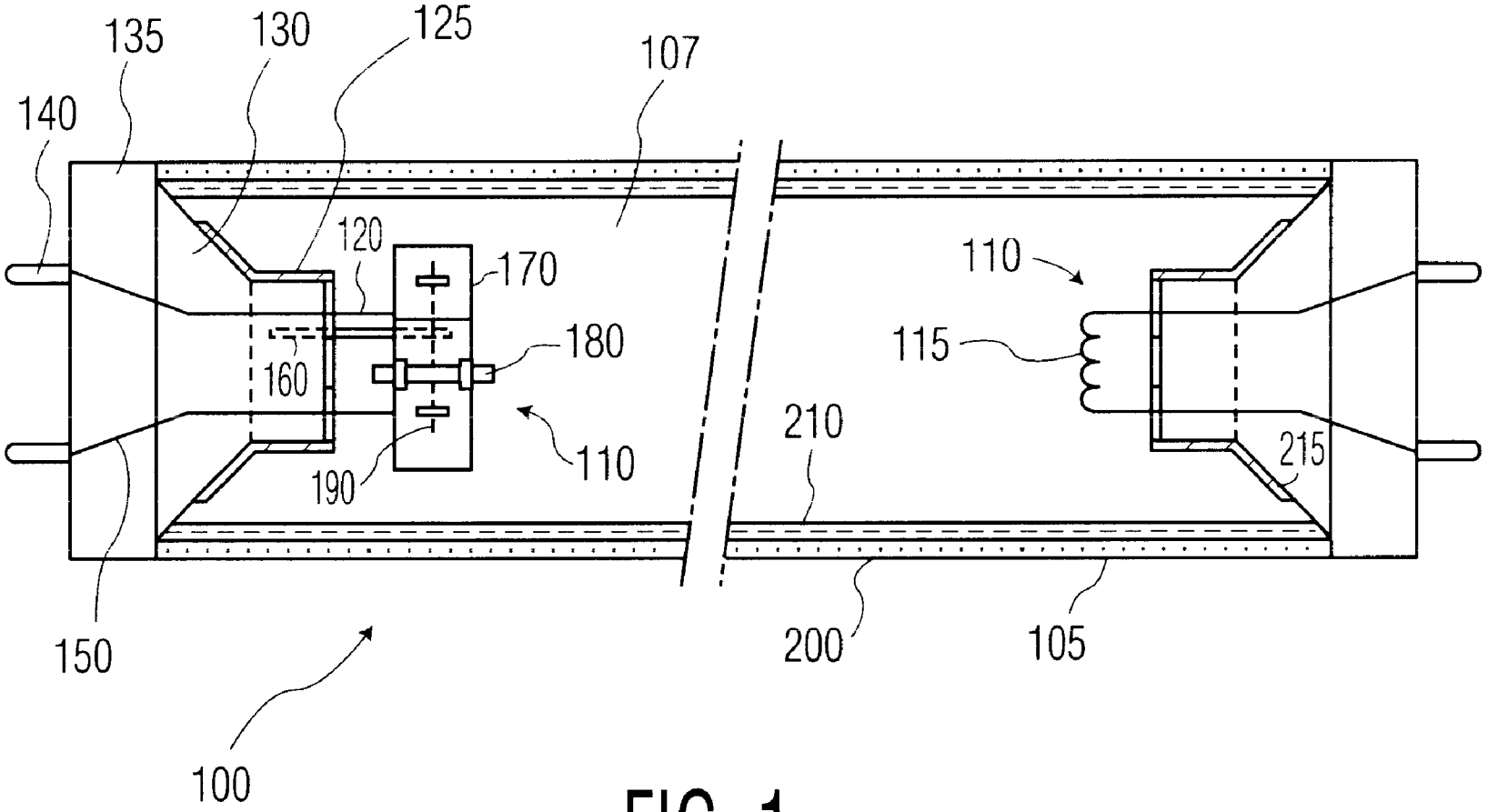
FIG. 1 shows a Colortone fluorescent lamp according to present invention.

FIG. 1 shows a low-pressure mercury vapor discharge or fluorescent lamp 100 with an elongated outer envelope 105 which encloses a discharge space 107 in a gastight manner. The lamp 100 shown in the illustrative example of FIG. 1 is tubular lamp, preferably having a length of approximately 0.5 to 8 feet long, operating on a current from approximately 0.160 to 1.500 Amps, and a lamp power approximately from 4.0 to 215 Watts, for example. However, the lamp may be a compact fluorescent lamp, and the lamp may have other operating parameters and have other shapes like curved shapes, such as U-shape or circular, or any other desired shape.

Illustratively, the lamp 100 has a conventional electrode structure 110 at each end which includes a filament 115 made of tungsten, for example. Alternatively, the electrode structure 110 may be provided at only a single end, particularly for compact fluorescent lamps. The electrode structure 110 is not the essence of the present invention, and other structures may be used for lamp operation to generate and maintain a discharge in the discharge space 107. For example, a coil positioned outside the discharge space 107 may be used to generate an alternating magnetic field in the discharge space for generating and maintaining the discharge.

Returning to the illustrative lamp 100 of FIG. 1, the filament 115 of the electrode structure 110 is supported on conductive lead wires 120 which extend through a glass press seal 125 located at one end of a mount stem 130 near the base 135 of the lamp 100. The leads 120 are connected to pin-shaped contacts 140 of their respective bases 135 fixed at opposite ends of the lamp 100 though conductive feeds 150.

A center lead wire 160 extends from each mount 130 through each press seal 125 to support a cathode ring 170 positioned around the filament 115. A glass capsule 180 with which mercury was dosed is clamped on the cathode ring 170 of only one of the mounts 130. The other mount does not contain a mercury capsule, however a cathode guard 170 may be provided around its filament 115, which has been omitted in FIG. 1 in order to show the filament 115.

A metal wire 190 is tensioned over the mercury glass capsule 180. The metal wire 190 is inductively heated in a high frequency electromagnetic field to cut open the capsule 180 for releasing mercury into the discharge space 107 inside the envelope 105.

The discharge space 107 enclosed by the envelope 105 is filled with an ionizable discharge-sustaining filling which includes an inert gas such as argon, or a mixture of argon and other gases, at a low pressure. The inert gas and a small quantity of mercury sustain an arc discharge during lamp operation. In the operation of the lamp 100, when the electrodes 110 are electrically connected to a source of predetermined energizing potential via the contact pins 150, a gas discharge is sustained between the electrodes 110 inside the envelope 105. The gas discharge generates ultraviolet (UV) radiation which is converted to visible light by a phosphor luminescent layer shown as numeral 210 in FIG. 1.

In particular, the inner surface of the outer envelope 105 is pre-coated with a single layer of a metal oxide, such as aluminum oxide $Al_2O_3$200, over which a phosphor luminescent layer 210 is formed. The alumina pre-coat 200 reflects the UV radiation back into the phosphor luminescent layer 210 through which it has already passed for further conversion of the UV radiation to visible light. This improves phosphor utilization and enhances light output. The alumina pre-coat 200 also reduces mercury consumption by reducing mercury diffusion into the glass lamp envelope 105. To further reduce mercury consumption, the glass mount stems 130 and press seals 125 may also be coated with an alumina pre-coat layer 215, to reduce mercury bound to the glass mount stems 130 and press seals 125.

The alumina pre-coat layer 200 is applied by liquid suspension according to commonly employed techniques for applying phosphor layers on the inner surface of the lamp envelope 105. For example, aluminum oxide is suspended in a water base solution and flushed down the lamp tube or envelope 105 to flow over the envelope inner surface until it exits from the other end. The solution is dried in a drying chamber and then the phosphor coat 210 is applied in a similar fashion and sintered or baked for a period of time.

The alumina pre-coat layer 215 may be formed over the glass mount stems 130 and press seals 125 by methods well known in the art, such as by painting the glass mount stems 130 and press seals 125 with the water solution containing suspended aluminum oxide, followed by drying and sintering.

For the 5000K Colortone fluorescent lamp according to the present invention, where the color temperature is about 5000K, i.e., in degree Kelvin, (5000K), the phosphor coat 210 comprises a mixture of four phosphors. The phosphor mixture consists of blue-luminescing Blue Halophosphor (BH) activated by Sb, i.e., $Ca_{10}(PO_4)_6F_2$:Sb; red-luminescing Yittrium Oxide (YOX) activated by Eu, i.e., $Y_{203}$:Eu; 3000K-luminescing Calcium Halophosphor, also referred to as Warm White (WW) activated by Sb, Mn, i.e., $Ca_{10}(PO_4)_6(F,C1)_2$:Sb,Mn; and green-luminescing Zinc Silicate (ZS) activated by Mn, i.e., $Zn_2SiO_4$:Mn.

The 5000K Colortone fluorescent lamp with this four-phosphor mixture exhibits higher lumens than conventional Colortone 50 lamps with Sr. Mag and Sr. Blue phosphor mixture. In particular, the 5000K Colortone fluorescent lamp provides approximately 2500 lumens and meets the color acceptance requirement for ANSI and ISO, as shown in Tables 1–2.

Table 1 shows the 100 hour photometry results for four samples C5000K-1 to C5000K-4 of the 5000K Colortone fluorescent lamp according to the present invention, and the conventional Colortone 50 lamp, listed as C50, with the Sr. Mag and Sr. Blue phosphor mixture. Columns 3 and 4 show the X and Y color point co-ordinates; column 5 shows the correlated color temperature (CCT); and column 6 shows the lumens values for the test lamp samples.

TABLE 1

| Lamp | Actual CRI | X | Y | CCT | Lumens |
|---|---|---|---|---|---|
| C50 | 89.5 | .3498 | .3654 | 4875 | 1925 |
| C5000K-1 | 92.0 | .3487 | .3564 | 4879 | 2524 |
| C5000K-2 | 92.3 | .3476 | .3605 | 4934 | 2579 |
| C5000K-3 | 91.8 | .3492 | .3551 | 4857 | 2518 |
| C5000K-4 | 92.0 | .3507 | .3564 | 4808 | 2479 |

Although the 5000K Colortone fluorescent lamps C5000K-1 to C5000K-4 according to the present invention have a higher lumen output than the conventional C50 lamp, the crucial factors are the XY color point co-ordinates and CRI values. According the ANSI standards, the color rendering CRI or Ra must be over 90, while the ISO standard not only requires a CRI>90, but also requires the separate special color rendering indices $R_1$ to $R_8$ be over 80. The general color rendering index Ra is the mean of the special color rendering indices Ri, such as $R_1$ to $R_8$. For the general CRI or Ra values close to 100, the special color rendering index values Ri are unlikely to show large variations for noticeable color differences. However, as the Ra value decreases from 100, the variation in the Ri indices increases. Typically, the best color rendering lamps not only have high CRI, but also have the least variation in the Ri.

TABLE 2

| Conventional C50 lamp | Inventive C5000K lamp |
|---|---|
| X = 0.3498 | X = 0.3487 |
| Y = 0.3654 | Y = 0.3564 |
| Ra = 89.50 | Ra = 92.00 |
| $R_1$ = 88.96 | $R_1$ = 94.02 |
| $R_2$ = 90.80 | $R_2$ = 98.16 |
| $R_3$ = 88.04 | $R_3$ = 87.12 |
| $R_4$ = 90.80 | $R_4$ = 87.12 |
| $R_5$ = 88.96 | $R_5$ = 95.40 |
| $R_6$ = 86.66 | $R_6$ = 98.62 |
| $R_7$ = 93.56 | $R_7$ = 94.02 |
| $R_8$ = 88.50 | $R_8$ = 81.60 |

Table 2 shows the general color rendering index Ra, i.e., the CRI, and the special color rendering indices $R_1$ to $R_8$. As seen from Table 2, the general color rendering index Ra is greater than 90 for the 5000 K Colortone fluorescent lamp according to the present invention, thus meeting the ANSI standard, and the special color rendering indices $R_1$ to $R_8$ are all greater than 80, thus also meeting the ISO standard.

Figure 2:
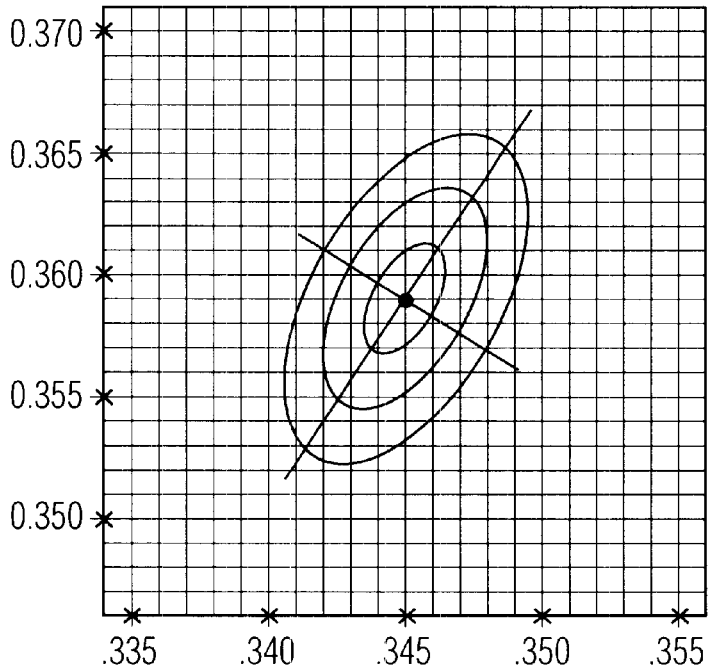
FIG. 2 shows the color acceptance criteria for the 5000K Colortone fluorescent lamp according to present invention.

FIG. 2 shows the color acceptance criteria for 5000K Colortone fluorescent lamps, having three-step ellipses with the center as X=0.345 and Y=0.359 and a major axis approximately between 0.341, 0.353 and 0.349, 0.365, and a minor axis approximately between 0.361, 0.342 and 0.348, 0.357.

Figure 3:
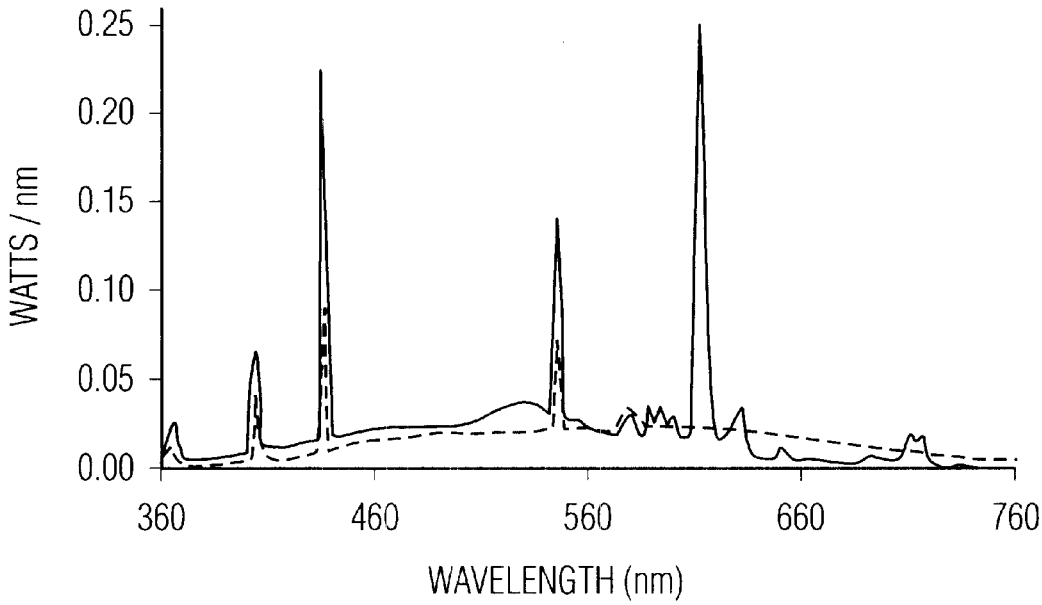
FIG. 3 shows the emission spectrum of the 5000K Colortone fluorescent lamp according to the present invention.

FIG. 3 shows the emission spectrum of the 5000K Colortone fluorescent lamp according to the present invention in a solid line, and the emission spectrum of the conventional C50 Colortone fluorescent lamp in dashed lines.

The four-phosphor mixtures of the inventive 5000K Colortone lamp allow the lamp 100 to have reduced mercury consumption in conjunction with the alumina pre-coat 200 which shields the glass envelope 105 from mercury. In addition to the alumina pre-coat 200, the phosphor layer 210 provides lower mercury consumption than other phosphors, as well as increased brightness.

The increased brightness and reduced mercury consumption is achieved by replacing the phosphor layer of a conventional lamp with a layer of the four-phosphors mixture layer over the UV alumina pre-coat layer. In particular, the lamps used to obtain the 100 photometry results shown in Tables 1–2, were F40T12, which are straight tubular lamps having a length of 4 feet. The raw phosphor weight used was approximately 6.5±0.2 g. By contrast, the weight of the four-phosphor mixture layer 210 is considerably lower, such as approximately 5.5 g to 6.0 g. Thus, the inventive lamps have a phosphor weight of approximately 1.375 to 1.5 grams per foot. The weight of the alumina pre-coat layer 200 is approximately 120–240 mg.

Table 3 shows the particular composition of the four phosphor mixture of the 5000K Colortone fluorescent lamp C5000K according to the present invention, in comparison to the conventional 50 Colortone fluorescent lamp C50, given as approximate weight percentages.

TABLE 3

| Lamp | Phosphors | Weight % |
|---|---|---|
| C50 | Stron. Mag | 43.0 |
| | Stron. Blue | 57.0 |
| C5000K | BH | 44.91 |
| | YOX | 31.34 |
| | WW | 11.99 |
| | ZS | 11.75 |

Conventional 4 ft Colortone lamps are manufactured with approximately 15–40 mg of mercury. By contrast, the inventive Colortone lamps with the four phosphor mixture having a length of 4 ft with a lamp life of 20,000 hours, require less than 15 mg, namely approximately 3 mg to 8 mg for lamps having a length of 8 feet or less, such as approximately 4.4 mg of mercury for 4 foot lamps, and still maintain the rated lamp life and the high lumens output as listed in table 1, namely approximately 2500 lumens for the 5000 K lamps. Thus, the inventive lamps have approximately 1.0 to 1.1 mg of mercury per foot.

The increased light output and reduced mercury consumption are due to the superior components of the phosphor 210, as well as the UV pre-coat layer 200 which reduces the interaction of mercury ions with the glass envelope 105 and reflects the UV rays more efficiently back into the phosphor layer 210 to improve utilization of the phosphor and enhance visible light production.

While the present invention has been described in particular detail, it should also be appreciated that numerous modifications are possible within the intended spirit and scope of the invention. In interpreting the appended claims it should be understood that:

a) the word "comprising" does not exclude the presence of other elements than those listed in a claim;

b) the word "consisting" excludes the presence of other elements than those listed in a claim;

c) the word "a" or "an" preceding an element does not exclude the presence of a plurality of such elements.

d) any reference signs in the claims do not limit their scope; and e) several "means" may be represented by the same item of hardware or software implemented structure or function.

What is claimed is:

1. An electric lamp comprising:

an envelope having an inner surface and enclosing a discharge space filled with mercury having a weight of less than 15 mg;

at least one electrode for generating ultraviolet radiation in said discharge space; and a phosphor layer formed over said inner surface to convert said ultraviolet radiation to visible light;

wherein said phosphor layer is formulated to provide a color rendering index of at least 90, at a color temperature of approximately 5000 K.

2. The electric lamp of claim 1, wherein said phosphor layer consists of Blue Halophosphor, Yittrium Oxide, Calcium Halophosphor, and Zinc Silicate.

3. The electric lamp of claim 1, wherein said phosphor layer consists of approximately 45% weight of Blue Halophosphor, approximately 31% weight of Yittrium Oxide, approximately 12% weight of Calcium Halophosphor, and approximately 12% weight of Zinc Silicate.

4. The electric lamp of claim 1, wherein said weight of said mercury is approximately 1.0 to 1.1 mg/ft.

5. The electric lamp of claim 1, further comprising an aluminum oxide layer formed between said inner surface and said phosphor layer.

6. The electric lamp of claim 1, wherein a weight of said phosphor layer is approximately 1.375 to 1.5 grams per foot.

7. An electric lamp comprising:

an envelope having an inner surface;

at least one electrode for generating ultraviolet radiation within the envelope; and a phosphor layer formed over said inner surface to convert said ultraviolet radiation to visible light;

wherein said phosphor layer is formulated to provide a general color rendering index of at least 90 and a color temperature of approximately 5000K.

8. The electric lamp of claim 7, wherein said phosphor layer consists of Blue Halophosphor, Yittrium Oxide, Calcium Halophosphor, and Zinc Silicate.

9. The electric lamp of claim 7, wherein said phosphor layer for said color temperature of approximately 5000K consists of approximately 45% weight of Blue Halophosphor, approximately 31% weight of Yittrium Oxide, approximately 12% weight of Calcium Halophosphor, and approximately 12% weight of Zinc Silicate.

10. The electric lamp of claim 7, further comprising mercury located within said envelope, wherein said mercury has a weight of less than 15 mg.

11. The electric lamp of claim 7, further comprising mercury located within said envelope, wherein said mercury has a weight of approximately 1.0 to 1.1 mg/ft.

12. The electric lamp of claim 7, where in a weight of said phosphor layer is approximately 1.375 to 1.5 grams per foot.

13. An electric lamp comprising:

an envelope having an inner surface;

at least one electrode for generating ultraviolet radiation within the envelope; and a phosphor layer formed over said inner surface to convert said ultraviolet radiation to visible light;

wherein said phosphor layer consists of Blue Halophosphor, Yittrium Oxide, Calcium Halophosphor, and Zinc Silicate.

14. The electric lamp of claim 13, wherein said phosphor layer consists of approximately 45% weight of Blue Halophosphor, approximately 31% weight of Yittrium Oxide, approximately 12% weight of Calcium Halophosphor, and approximately 12% weight of Zinc Silicate.

15. The electric lamp of claim 13, wherein said phosphor layer is formulated to provide a color rendering index of at least 90 at a color temperature of approximately 5000K.

16. The electric lamp of claim 13, wherein said phosphor layer is formulated to provide a color rendering index of at least 90.

17. The electric lamp of claim 13, wherein said phosphor layer is formulated to provide a color temperature of approximately 5000K.

18. The electric lamp of claim 13, further comprising mercury located within said envelope, wherein said mercury has a weight of less than 15 mg.

19. The electric lamp of claim 13, further comprising mercury located within said envelope, wherein said mercury has a weight of approximately 1.0 to 1.1 mg/ft.

20. The electric lamp of claim 17, wherein a weight of said phosphor layer is approximately 1.375 to 1.5 grams per foot.

* * * * *